US006308928B1

(12) United States Patent
Galant

(10) Patent No.: US 6,308,928 B1
(45) Date of Patent: Oct. 30, 2001

(54) ANTI THEFT DEVICE FOR LAPTOP COMPUTER

(75) Inventor: Steve N. Galant, Mississauga (CA)

(73) Assignee: Compucage International Inc. (CA)

( * ) Notice: Subject to any disclaimer, the term of this patent is extended or adjusted under 35 U.S.C. 154(b) by 0 days.

(21) Appl. No.: 09/563,184

(22) Filed: May 2, 2000

(51) Int. Cl.[7] ..... E05B 73/00
(52) U.S. Cl. ..... 248/553; 70/58; 70/19
(58) Field of Search ..... 248/551, 552, 248/553; 70/18, 19, 58, 164, 209

(56) References Cited

U.S. PATENT DOCUMENTS

| | | | | |
|---|---|---|---|---|
| 3,744,282 | * | 7/1973 | Hemphill | 70/58 |
| 4,028,913 | | 6/1977 | Falk . | |
| 4,170,334 | * | 10/1979 | Villanueva | 248/553 |
| 4,585,202 | | 4/1986 | Parsekian . | |
| 5,052,199 | | 10/1991 | Derman . | |
| 5,277,042 | * | 1/1994 | Tobias | 70/209 |
| 5,351,508 | | 10/1994 | Kelley . | |
| 5,582,044 | | 12/1996 | Bolich . | |
| 5,595,074 | | 1/1997 | Munro . | |
| 5,642,634 | | 7/1997 | Perry . | |
| 5,836,183 | | 11/1998 | Derman . | |

* cited by examiner

*Primary Examiner*—Leslie A. Braun
*Assistant Examiner*—Jon Szumny
(74) *Attorney, Agent, or Firm*—Gifford, Krass, Groh, Sprinkle, Anderson & Citkowski, P.C.

(57) ABSTRACT

A security device for securing a laptop computer to a support member such as a desk top. The security device includes a rigid first securing member having back, side and front restraining members defining an elongate opening through which the monitor portion of the laptop computer can be slidably received when the laptop computer is in an open position. A leg extends from the first securing member for insertion through a predetermined hole provided through the desk top. The security device includes a lock device for engaging a portion of the leg that has been inserted through the hole and for engaging the lower surface of the desk top to prevent separation of the first securing member from the desk top when the lock device is locked. When the key board portion is located on the upper surface of the support member, the monitor portion is slidably received within the rigid first securing member and the leg is inserted through the hole and engaged by the lock device, the rigid first securing member restrains movement of the laptop computer lateral to and upward from the upper surface of the desk top. A second securing member can be interlocked with the rigid first securing member in order to secure a closed laptop computer to the desk top.

18 Claims, 6 Drawing Sheets

ANTI THEFT DEVICE FOR LAPTOP COMPUTER

BACKGROUND OF THE INVENTION

The present invention relates to an anti-theft device for securing a laptop computer to a support surface such as a desk top.

A variety of techniques and apparatus have been developed over the years to prevent the unauthorized removal of computer equipment. A number of security devices have been developed specifically for tower style and desk top computers, as depicted in U.S. Pat. No. 5,085,395 issued Feb. 4, 1992 to Fater et al, and U.S. Pat. No. 4,585,202 issued Apr. 29, 1986 to Parsekin. Such devices are not designed to be used with clam shell style laptop computers which are most often the targets of computer theft.

Security devices which use flexible cables to secure either laptop computers or tower and desk top style computers are also known. However, such devices offer limited security as the cables can often be cut relatively easily.

There is a need for an anti-theft device that can be used to secure a laptop computer to a work surface, and which provides an increased level of security over traditional cable devices.

It is therefore desirable to provide a security device that can be used to secure a laptop computer, which is easily removable to facilitate portability of the laptop computer, and which is cost efficient to manufacture. It is also desirable to provide a security device that can be used to secure a laptop computer in both the open and shut positions.

SUMMARY OF THE INVENTION

The present invention provides a rigid frame security device which can be used to secure a laptop computer to a work surface such as a desk top. An embodiment of the security device can be used to secure both open and closed laptop computers.

According to one aspect of the invention, there is provided a security device for securing a laptop computer to a support member having a generally planar upper surface and a lower surface, the laptop computer having a monitor portion and a keyboard portion pivotally connected together by a hinge for movement between an open position in which the monitor portion extends at an angle from the keyboard portion, and a closed position in which the monitor portion and keyboard portion are substantially parallel to and adjacent each other. The security device comprises a rigid first securing member having back, side and front restraining members defining an elongate opening through which the monitor portion can be slidably received when the laptop computer is in an open position, a leg extending from the first securing member for insertion through a predetermined hole provided through the support member, and a lock device for engaging the lower surface of the support member and a portion of the leg that has been inserted through the hole to prevent separation of the rigid first securing member from the support member when the lock device is locked. When the keyboard portion is located on the upper surface of the support member, the monitor portion is slidably received within said rigid first securing member and the leg is inserted through the hole and engaged by the lock device, the rigid first securing member restrains movement of the laptop computer parallel to and upward from the upper surface of the support member. Preferably, the security device includes a further leg parallel to the leg and extending from the first securing member for insertion through a further predetermined hole provided through the support member. The legs can be spaced apart from each other a distance sufficient to straddle a width of the laptop computer when the laptop computer is in its closed position, and the security device can optionally include a second securing member comprising an elongate intermediate member with a first and second stop members located at opposite ends thereof for restraining movement of the laptop computer, the first and second securing members having interlocking portions and being positioned generally transverse to each other when interlocked together. When the laptop is in its closed position and positioned between the hole and the further hole it can be secured to the upper surface of the support member with the legs and the first and second stop members restraining movement of the laptop computer parallel to the upper surface, and the rigid first securing member and intermediate member restraining upward movement of the laptop computer.

According to a further aspect of the invention, there is provided a security device for securing a laptop computer to a support member having a generally planar upper surface and a lower surface, the laptop computer having a monitor portion and a keyboard portion pivotally connected together by a hinge for movement between an open position in which the monitor portion extends at an angle from the keyboard portion, and a closed position in which the monitor portion and keyboard portion are substantially parallel to and adjacent each other. The security device comprises a rigid first securing member having an elongate opening through which the monitor portion can be slidably received when in an open position, the opening being defined by back restraining means for restraining backward movement of the laptop computer, side restraining means for restraining sideways movement of the laptop computer, and front restraining means for restraining forward and upward movement of the laptop computer. First and second spaced apart parallel legs extend downwardly from the rigid securing member for insertion through predetermined first and second holes, respectively, provided through the support member. A lock device is engageable with the lower surface of the support member and a portion of the first leg inserted through the first hole thereby preventing separation of the first securing member from the support member when the lock device is locked. When the keyboard portion is located on the upper surface of the support member, the monitor portion is slidably received within the rigid first securing member and the first and second legs are inserted through the first and second holes respectively and the first leg engaged by the lock device, the security device restrains movement of the laptop computer relative to the support member.

According to still a further aspect of the invention, there is provided a security device for securing a laptop computer to a support member having a planar upper surface and a lower surface, the laptop computer having a monitor portion and a keyboard portion pivotally connected together by a hinge for movement between an open position in which the monitor portion extends at an angle from the keyboard portion, and a closed position in which the monitor portion and keyboard portion are substantially parallel to and adjacent each other, the laptop computer having a predetermined length, width and height when in its closed position, the security device comprising an elongate rigid first securing member, first and second spaced apart parallel legs extending downwardly from the first securing member for insertion through first and second predetermined holes, respectively, provided through the support member, the legs being spaced apart a sufficient distance such that the rigid first securing member extends across the width of the laptop computer with the legs straddling the laptop computer when the laptop computer is in its closed position with its keyboard portion resting on the support member. The security device also includes a second securing member comprising an elongate intermediate member having a first stop member extending downwardly from a first end thereof, and a second stop member extending downwardly from a second end thereof, the intermediate member being connectible substantially transversely to the first securing member, the first and second stop members being spaced apart a sufficient distance such that the intermediate member can extend across the length of the laptop computer with the stop members being positioned on opposite sides of the laptop computer, and a lock device for engaging the lower surface of the support member and a portion of the first leg inserted through the first hole thereby preventing separation of the first securing member from the support when the lock device is locked. When the laptop computer is positioned in the closed position on the upper surface of the support member between the first and second legs and the first leg is engaged by the lock device, the first and second legs, the first and second stop members, the first securing member and the intermediate member prevent removal of the laptop computer from the support member.

BRIEF DESCRIPTION OF THE DRAWINGS

For a better understanding of the invention, and to show how it may be carried into effect, reference will now be made, by way of example, to the accompanying drawings, in which.

DESCRIPTION OF THE PREFERRED EMBODIMENTS

Figure 1:
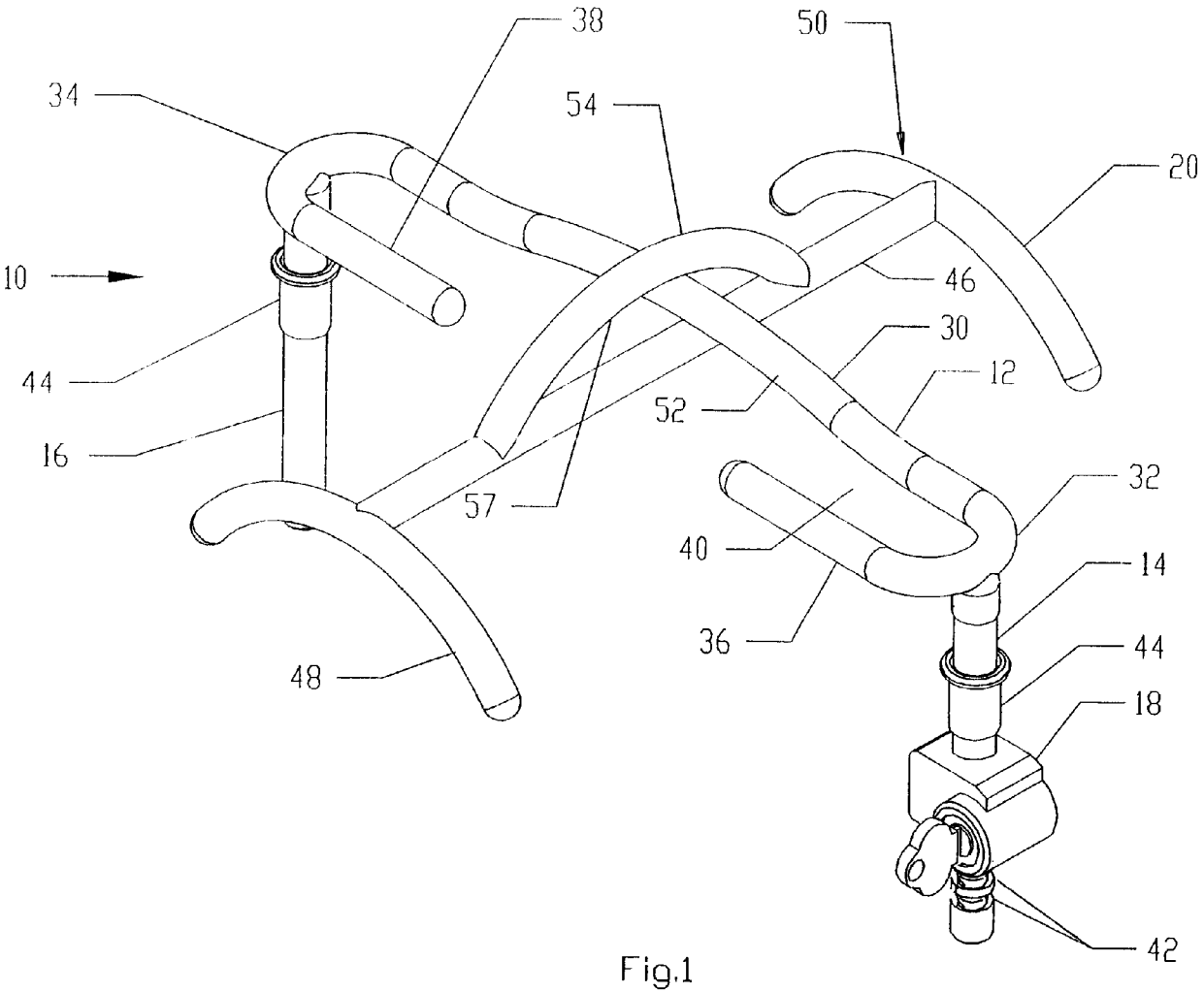
FIG. 1 is a perspective view of a security device in accordance with a preferred embodiment of the invention.

Referring to the drawings, FIG. 1 illustrates a security device, indicated generally by reference numeral number 10. The security device 10 includes a rigid first securing member 12 and parallel, spaced-apart first and second legs 14 and 16 which extend downwardly from opposite ends of the securing member 12. The security device 10 further includes a lock device 18 which can be secured to the first leg 14, and preferably a second securing member 20.

Figure 2:
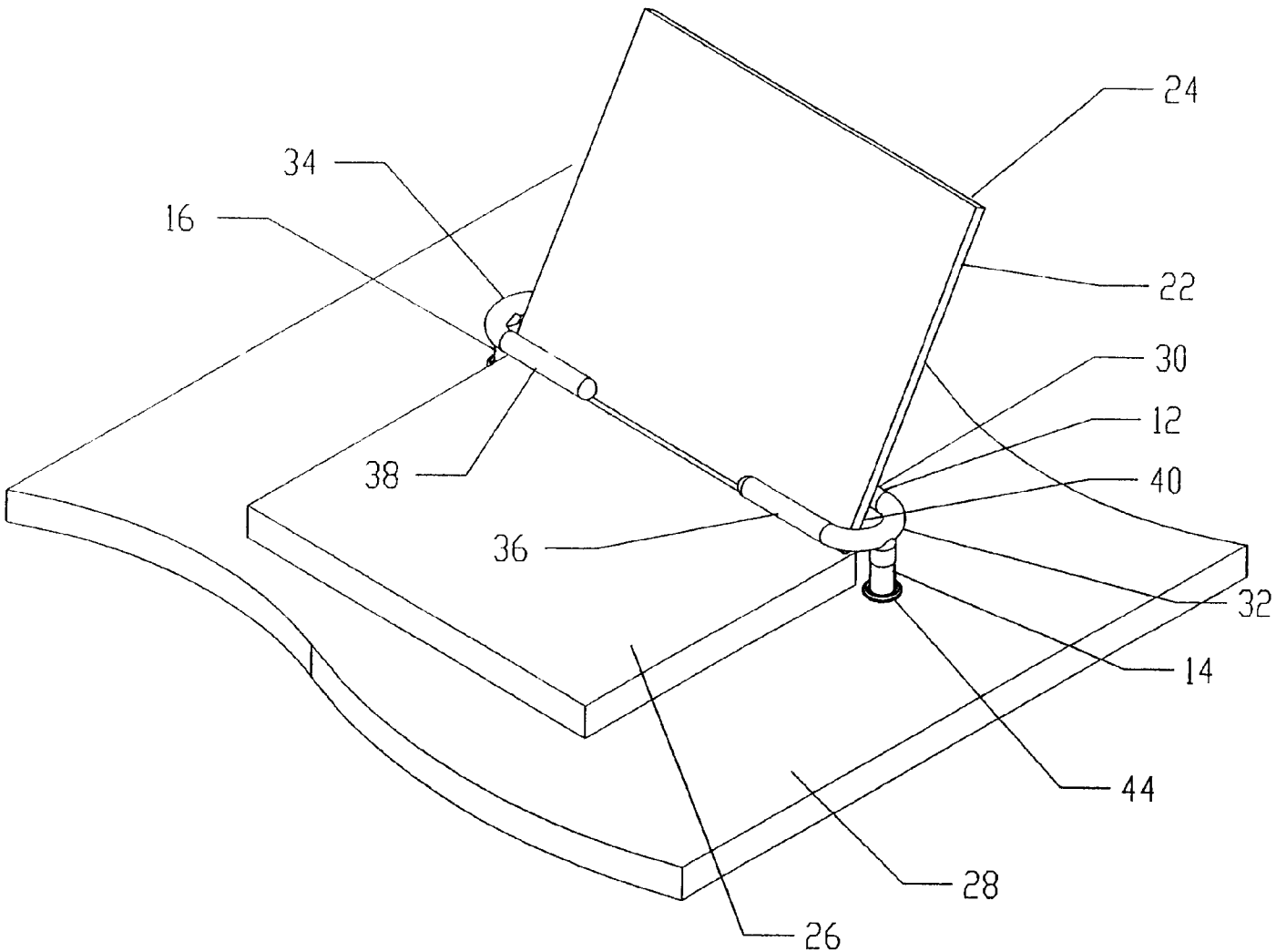
FIG. 2 is a perspective view showing a laptop computer in the open position secured to a desk top by the security device of FIG. 1.
Figure 3:
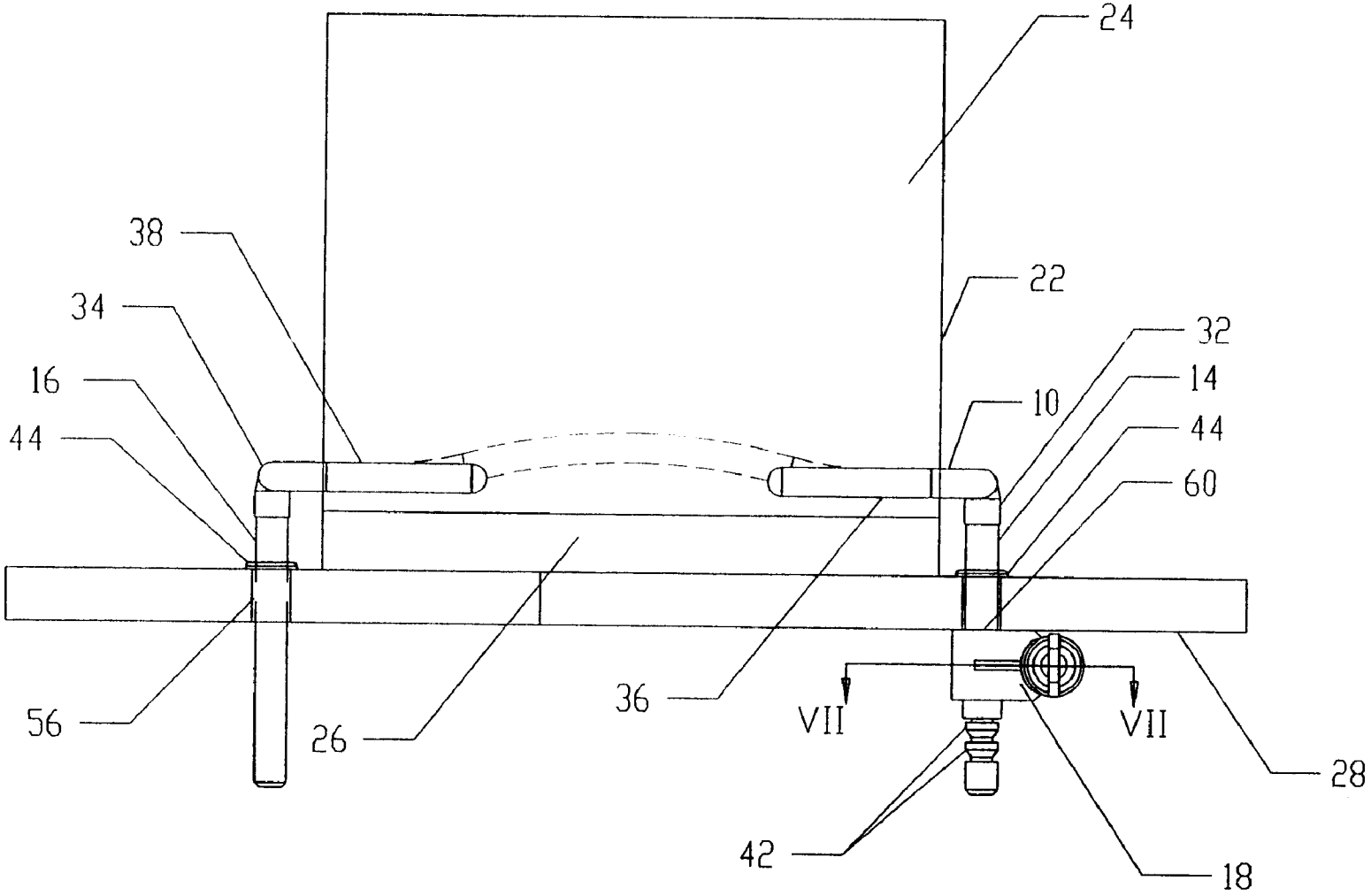
FIG. 3 is a front view showing the security device of FIG. 1 mounted on a support member such as a desk top.
Figure 4:
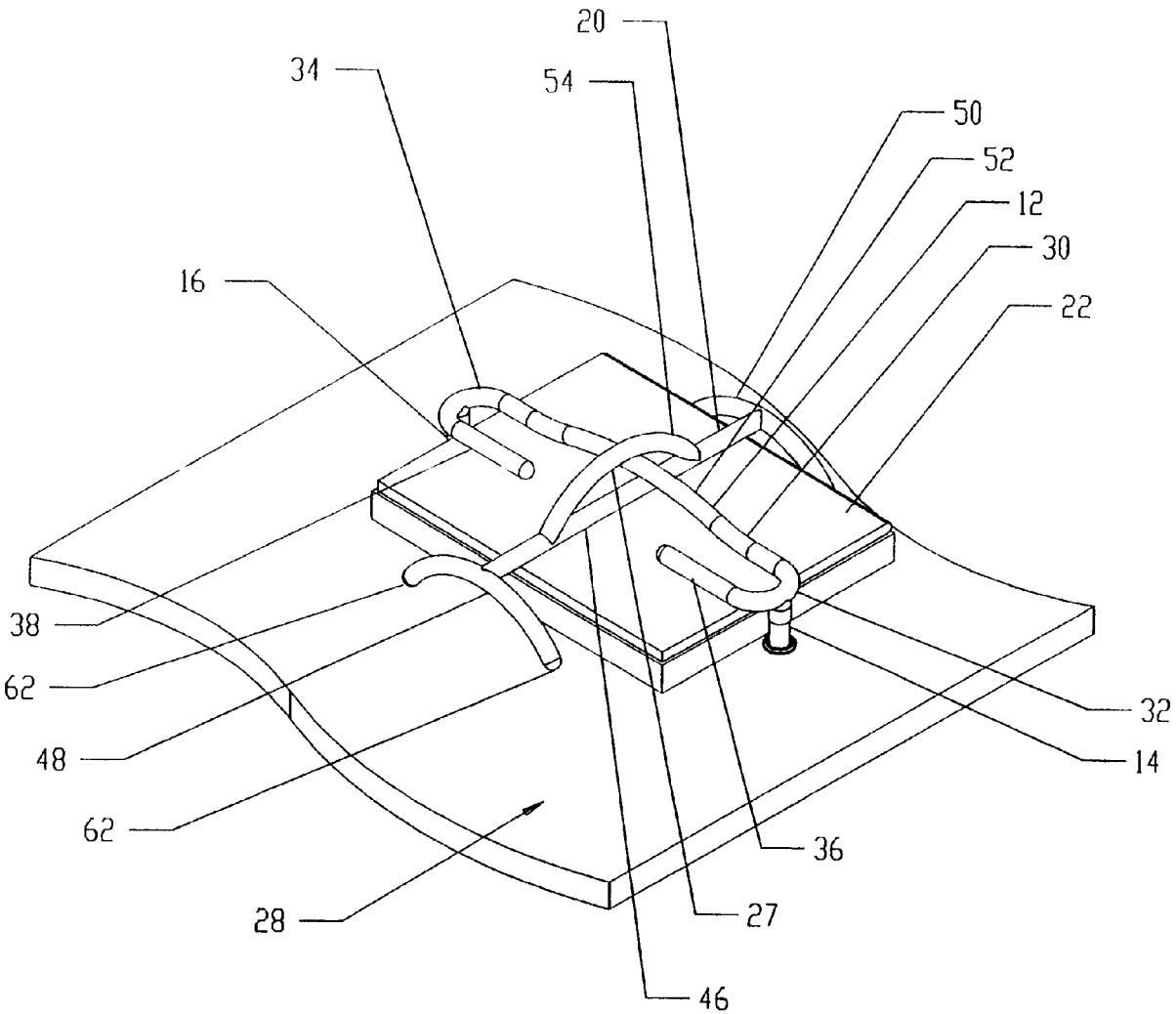
FIG. 4 is a perspective view showing a laptop computer in the closed position secure to a desk top by the security device of FIG. 1.

As shown in FIGS. 2 and 3, the security device 10 can be used, without the second securing member 20, to secure an open laptop computer 22 (the laptop computer 22 being a conventional clam shell style laptop having a monitor portion 24 that is mounted by a hinge to keyboard portion 26) to a planar support member such as a desk top 28. As shown in FIG. 4, the security device 10 can also be used with the second securing member 20 to secure the laptop computer 22 to the desk top 28 when the laptop computer 22 is in a closed position.

With reference to FIGS. 1 to 4, the components of the security device 10 will now be explained in greater detail. The first rigid securing member 12 includes an elongate back restraining bar or member 30 which has a width greater than the width of the monitor portion 24 of the laptop computer. First and second generally U-shaped side restraining members 32, 34, are provided on opposite ends of the back restraining bar 30. A first front restraining bar 36, which is spaced apart from and substantially parallel to the back restraining bar 36, extends from a forward end of the first restraining member 32. Similarly, a second restraining bar 38, which is also spaced apart from and substantially parallel to the back restraining bar 36, extends from a forward end of the second restraining member 34. The first and second front restraining members 36 and 38 are spaced apart from the back restraining bar 30 a distance sufficient to accommodate the thickness of the monitor portion 24 of the laptop computer. Preferably, the rigid securing member 12 is formed from vinyl coated hardened tubular steel.

The back, side and front restraining members of the securing member 12 define an elongate opening 40 which can slidably receive the monitor portion 24 of laptop computer 22. The first leg 14 extends downwardly from the first side restraining member 32, and the second leg 16, which is preferably formed from tubular hardened steel, extends downwardly from the second side restraining member 34.

The first leg 14 is preferably a hardened steel rod, having a plurality of uniformly spaced ratchet teeth 42 formed along the length thereof. The lock device 18 is preferably a key-locking device which is telescopically mounted on the first leg 14, and which includes a lock mechanism that, when the lock device 18 is locked, engages ratchet teeth 42 to prevent removal of the lock device 18.

As will be explained in greater detail below, in use the two legs 14 and 16 are inserted through predetermined holes provided through desk top 28.

In order to facilitate insertion and removal of the legs 14 and 16, and to protect the desk top 28, cylindrical plastic sleeves 44 can be provided. The sleeves 44 are configured to remain in the holes provided through the desk top 28 and slidably receive the legs 14, 16 when the security device is mounted on the desk top 28.

The second securing member 20 is provided to allow the security device 10 to be used to secure the laptop computer 22 when it is in a closed position, and is not required to secure the laptop computer in the open position. The second securing member 20 includes an elongate intermediate member or bar 46 with first and second stop members 48, 50 located at opposite ends thereof. In the embodiment shown, the first and second stop members 48, 50 are each downwardly arcuate bars. The second securing member 20 and first securing member 12 are each configured such that they interlock with each other. In particular, in the illustrated embodiment, the restraining bar 30 has a raised central portion 52 that the intermediate bar 46 can pass under, and an arcuate member 54 is provided on the upper side of the intermediate bar 46. The arcuate member 54 and intermediate bar 46 define an opening 57 through which the back restraining bar 30 passes.

With reference to FIGS. 2 and 3 the operation of the security device 10 to secure open laptop computer 22 to the desk top 28 will now be described in greater detail. The security device 10 is intended to be used with a desk top 28 having two holes 56 provided therethrough (see FIG. 3). The holes 56 are spaced apart an appropriate predetermined distance that is equal to the spacing of legs 14 and 16, and have a diameter sufficient to snugly receive plastic sleeves 44. The holes 56 will generally be located on the desk top 28 in such a location that the laptop computer will be conveniently located for use by a person when it is in its open position. Generally, the purchaser of the security device 10 will drill the holes 56 through the desk top 28 in preparation for using the security device 10, and will insert plastic sleeves 44 into the holes where they remain in order to facilitate insertion and removal of the first and second legs 14, 16 and protect the area of the upper surface of the desk 28 that surrounds the holes 56.

As illustrated in FIGS. 2 and 3, in order to secure the open laptop computer 22 to the desk top 28, the laptop computer is positioned with its keyboard portion 26 resting on the upper surface of desk top 28, with its width being located between holes 56 and the monitor portion 22 in its upwardly angled viewing position. The first securing member 12 is lowered such that the monitor portion 22 is received within the opening 40 that is defined by back, side and front restraining members 32, 34, 36 and 38. As the first securing member 12 is lowered, the first and second legs 14, 16 are received within holes 56 in the desk top 28 until the front restraining members 36 and 38 come to rest on, or are close to, an upper surface of the keyboard portion 26. Once the first securing member 12 is in position, then the lock device 18 is telescopically mounted onto the portion of the first leg 14 which has been inserted through the desk top 28 (it will be understood that the lock device 18 is removed from the first leg 14 to allow its insertion through the hole 56). The teeth 42 that are provided along the first leg 14 and the lock device 18 are preferably configured to function as a ratchet and pawl device such that when the lock device 18 is locked it can be telescoped upward along the leg 14 in engagement with the teeth 42, but not removed from the leg 14.

The lock device 18 includes an upper surface 60 for engaging the lower surface of the desk top 28, and is ratcheted upward along the first leg 14 until its upper surface 60 engages the lower surface of the desk top. Once in such a position, the lock device 18 prevents the first leg 14 from being withdrawn from the hole 56, thereby preventing separation of the first securing member 12 from the desk top 28. When the first securing member 12 is secured to the desk top 28, the back restraining bar 30 prevents any substantial rearward movement of the laptop computer 22 by engaging a lower portion of the back of the monitor portion 24 in the event that the laptop computer 22 is pushed backwards. Similarly, front restraining members 36 and 38 will prevent any substantial forward movement by contacting a lower front portion of the computer monitor 24, and any substantial upward movement through contact with the upper portion of keyboard portion 26.

The side restraining members 32 and 34 prevent any substantial sideway movement of the laptop computer 22 through contact with the sides of the monitor portion 24. Thus, it will be appreciated that the security device 10 essentially clamps the laptop computer to the desk top 28, preventing unauthorized removal of the laptop computer unless substantial damage is inflicted on the laptop computer. Of course, if substantial damage is inflicted on the computer, then its possible resale value is negligible, thereby removing the incentive to steal it.

The laptop computer 22 can easily be removed by a person possessing the key to lock device 18 simply by unlocking the lock device 18, removing it from the first leg 14, and subsequently removing the first securing member 12 from the desk top.

As indicated above, the security device 10 can include an optional second securing member 20 to allow it to be used to secure the laptop 22 to the desk top 28 when the laptop 22 is in its closed, non-use, position, thereby preventing unauthorized use of the laptop computer 22 as well as its unauthorized removal. With reference to FIG. 4, the closed laptop 22 is positioned between the holes 56 that are provided through the desk top 28 such that it can be straddled between the first and second legs 14 and 16 when they are inserted through the holes 56. Prior to mounting the first securing member 12 to the desktop 28, the first and second securing members 12 and 20 are interlocked by threading one of the legs 14 or 16 through the opening 57 of the second securing member 20 until the intermediate bar 46 is located under the raised central portion 52 of the back restraining member 30. The first and second securing members are then secured to the desk top 28 over the laptop computer 22 in the manner illustrated by inserting the first and second legs 14, 16 through the holes in the desk top 28 until the securing members contact an upper surface of the laptop computer. The lock device 18 is then used to secure the first leg 14 as discussed above.

The raised central portion 52 of the back restraining member 30 provides clearance for the intermediate bar 46 to pass underneath the back restraining member 30. The first and second arcuate stop members 48 and 50 each preferably include a pair of ends 62 which rest on the desk top 28.

Once the first and second securing members 12, 20 are secured to the desk top 28 over the closed laptop computer 22, the first and second legs 14 and 16 restrain sideways movement of the computer 22, and the first and second stop members 48, 50 restrain forward and backward movement. Upward movement is restrained by intermediate bar 46, and the back and front restraining members 30, 36 and 38.

Figure 5:
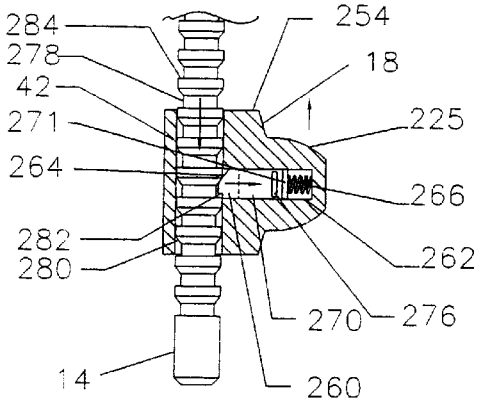
FIG. 5 is an enlarged partial cross sectional view of a portion of the lock device showing the ratchet teeth during insertion of the locking device.
Figure 6:
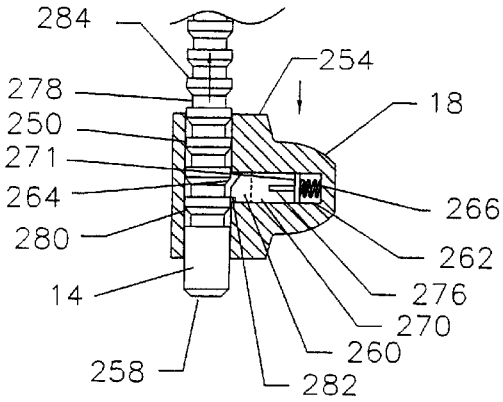
FIG. 6 is an enlarged partial cross sectional view of the same portion of the locking device shown in FIG. 5, showing the ratchet teeth being withdrawn from the locking device.
Figure 7:
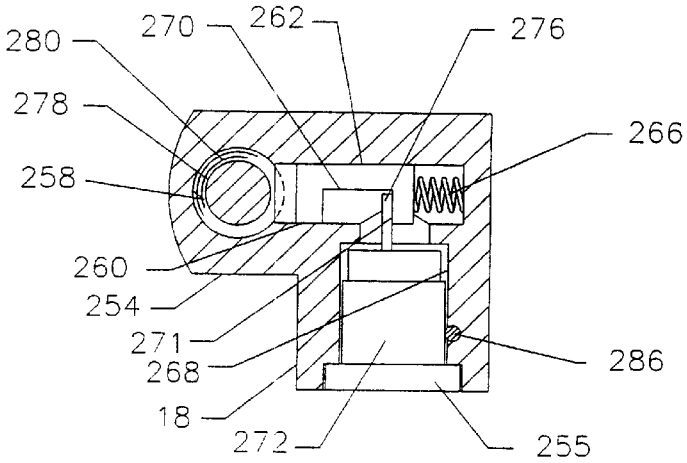
FIG. 7 is a detailed cross sectional view taken along the lines VII—VII of FIG. 3, showing a locking mechanism useful in connection with the present invention.

With reference to FIGS. 5–7, the operation of the locking device 18 and its interaction with the ratchet teeth 42 of the first leg 14 will now be described in greater detail. The locking device 18 has a hardened steel lock housing 254. A cylindrical passageway 258 is provided through the lock housing 254 for telescopically receiving the first leg 14.

The lock device 18 contains a pawl 260 in a blind hole 262, the pawl having an angular end surface 264 urged into the passageway 258 by a spring 266. The ratchet teeth 42 are preferably frustal-conical projections located along a portion of the length of the first leg 14.

FIG. 5 shows the action of a locking device with the first leg 14 being inserted into passageway 258, while FIG. 6 shows the locking device 18 in the unlocked position, with the pawl in a retracted position thereby facilitating removal of the locking device from the first leg 14. The lock housing 254 includes a blind hole 262, and a lock cylinder hole 268 at right angles to the blind hole 262. A locking mechanism 255 disposed within the lock housing 254 includes a coil spring 266 and a ratchet pawl 260 extending from the coil spring and through an end of the blind hole 262 into the annular passageway 258. The ratchet pawl 260 includes an angular end surface 264, a groove 270 and a torque blade surface 271 within the groove 270. The locking mechanism 255 further comprises a key lock cylinder 272 having a key slot and a torque blade 276. The torque blade extends into the groove 270 in the ratchet pawl 260 to register and co-operate with the torque blade surface 271.

Operation of the locking mechanism 255 is shown in FIGS. 5, 6 and 7. As shown in FIG. 7, the coil spring 266 normally biases the ratchet pawl 260 outwardly of the blind hole 262 into engagement with an inner cylindrical surface 278 of the ratchet teeth 42. Movement of the lock device 18 along the first leg as indicated by the arrow in FIG. 5 causes the conical bearing surface 280 of the ratchet teeth to act against the angular end surface 264 of the pawl, whereby the pawl 260 is biased into the blind hole 262 thereby compressing spring 266. As each ratchet tooth passes the pawl, the spring 266 urges the pawl back into the annular space between the conical surfaces. Use of the key lock cylinder 272 to rotate torque blade 276 to act against the torque blade surface 271 of the pawl, as shown in FIG. 6, holds the pawl position retracted from the annular passageway 258, thereby permitting removal of the lock device 18 from the first leg 14. However, with the pawl in a position shown in FIG. 5, the stop surface contact 282 of the pawl abuts the stop surface 284 of the ratchet tooth thereby preventing the locking device 18 from being removed from the first leg 14. FIG. 5 represents the locking device in the locked position. The key lock cylinder 272 is retained within the key hole by locking pin 286.

The sizing of the first and second securing members 12 and 20 is preferably such that the security device 10 can be used with different laptop computers falling within a predetermined range of conventional sizes.

Figure 8:
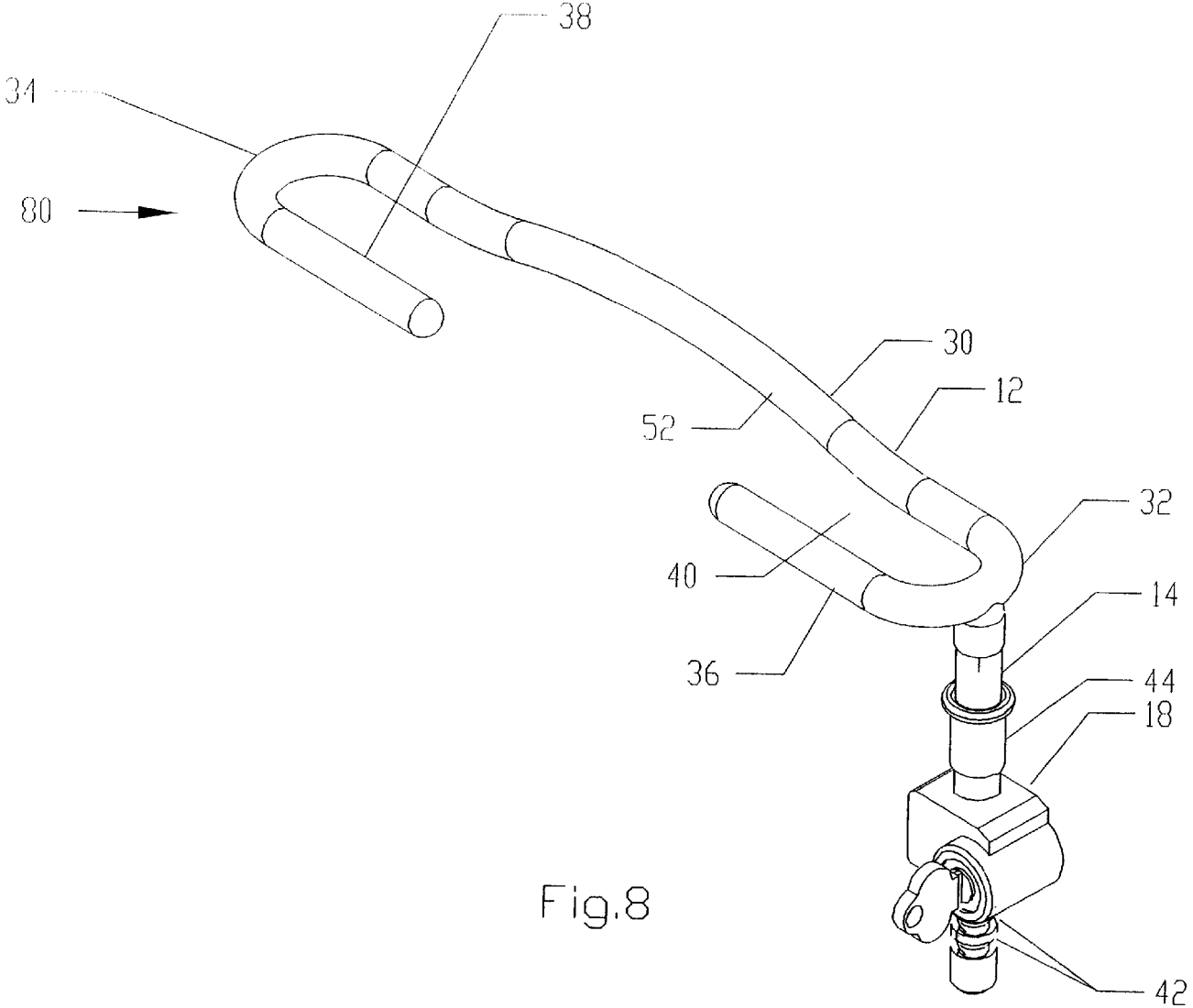
FIG. 8 is a perspective view of a further embodiment of a locking device in accordance with the present invention.

With reference to FIG. 8, a further possible embodiment of a security device, indicated generally by reference numeral 80, is illustrated. The security device 80, which is suitable for securing the lap top computer in its open position, is identical in construction and operation to the security device 10 described above, with the exception that the device 80 only includes a single leg 14 for insertion through the desk top 28 and does not include a second securing member 20.

It will be appreciated that the front restraining members 36 and 38 in the illustrated embodiments could be replaced with a single piece extending between the two side restraining members 32, 34, however the use of two separate front restraining members offers a benefit in that it minimizes visual interference with the monitor portion 24. It will also be appreciated that the security devices 10 and 70 need not include front restraining members at all if they are only used to secure the laptop computer in the closed position.

It will be appreciated that a different locking means could be used to secure the first leg other than that described above. For example, a series of spaced holes could be provided along the length of first leg 14 and used in conjunction with a padlock to secure the laptop computer to the desktop.

As will be apparent to those skilled in the art in the light of the foregoing disclosure, many alterations and modifications are possible in the practice of this invention without departing from the spirit or scope thereof. The foregoing description is of the preferred embodiments and is by way of example only, and is not to limit the scope of the invention.

I claim:

1. A security device for securing a laptop computer to a support member having a generally planar upper surface and a lower surface, the laptop computer having a monitor portion and a keyboard portion pivotally connected together by a hinge for movement between an open position in which the monitor portion extends at an angle from the keyboard portion, and a closed position in which the monitor portion and keyboard portion are substantially parallel to and adjacent each other, the security device comprising:

a first rigid securing member having back, side and front restraining members defining an elongate opening through which the monitor portion can be slidably received when the laptop computer is in an open position;

a leg extending from said securing member for insertion through a predetermined hole provided through the support member; and a lock device for engaging the lower surface of the support member and a portion of the leg that has been inserted through the hole to prevent separation of the rigid securing member from the support member when the lock device is locked, whereby when the keyboard portion is located on the upper surface of the support member, the monitor portion is slidably received within said rigid securing member and said leg is inserted through the hole and engaged by the lock device, said rigid securing member restrains movement of the laptop computer parallel to and upward from the upper surface of the support member.

2. The security device according to claim 1 including a further leg parallel to said leg and extending from said first securing member for insertion through a further predetermined hole provided through the support member.

3. The security device according to claim 2 wherein said first securing member includes a pair of said side restraining members, each side restraining member extending from an opposite end of said back restraining member, and a pair of said front restraining members, each extending from one of said side restraining members.

4. The security device according to claim 3 wherein said leg extends downwardly from one of said side restraining members and said further leg extends downwardly from the other one of said side restraining members.

5. The security device according to claim 2 wherein said leg and said further leg are spaced apart from each other a distance sufficient to straddle a width of the laptop computer when the laptop computer is in its closed position.

6. The security device according to claim 5 further including a second securing member comprising an elongate intermediate member and first and second stop members located at opposite ends thereof for restraining movement of the laptop computer said first and second securing members having interlocking portions and being positioned generally traverse to each other when interlocked together, wherein when the laptop is in its closed position and positioned between the hole and the further hole it can be secured to the upper surface of the support member with said leg and said further leg and said first and second stop members restraining movement of the laptop computer parallel to the upper surface, and said rigid first securing member and said intermediate member restraining upward movement of the laptop computer.

7. The security device according to claim 1 wherein said leg includes a plurality of ratchet teeth spaced longitudinally therealong, and said lock device includes a pawl engaging the ratchet teeth to prevent removal of said lock device from said leg when said lock device is locked.

8. The security device according to claim 7 wherein the pawl is spring loaded to permit the lock device to be telescoped onto the leg while preventing it to be removed therefrom when the lock device is locked.

9. The security device according to claim 7 wherein the lock device includes a key lock which actuates the pawl to engage and disengage the ratchet teeth.

10. A security device for securing a laptop computer to a support member having a generally planar upper surface and a lower surface, the laptop computer having a monitor portion and a keyboard portion pivotally connected together by a hinge for movement between an open position in which the monitor portion extends at an angle from the keyboard portion, and a closed position in which the monitor portion and keyboard portion are substantially parallel to and adjacent each other, the security device comprising:

a rigid first securing member having an elongate opening through which the monitor portion can be slidably received when in an open position, said opening being defined by back restraining means for restraining backward movement of the laptop computer, side restraining means for restraining sideways movement of the laptop computer, and front restraining means for restraining forward and upward movement of the laptop computer;

first and second spaced apart parallel legs extending downwardly from said rigid first securing member for insertion through predetermined first and second holes, respectively, provided through the support member;

a lock device for engaging the lower surface of the support member and a portion of the first leg inserted through the first hole thereby preventing separation of the securing member from the support member when the lock device is locked, whereby when the keyboard portion is located on the upper surface of the support member, the monitor portion is slidably received within said rigid first securing member and said first and second legs are inserted through the first and second holes respectively and said first leg is engaged by said lock device, said security device restrains movement of the laptop computer relative to the support member.

11. The security device according to claim 10 wherein said first leg includes a plurality of ratchet teeth spaced longitudinally therealong, and said lock device includes a pawl engageable with the ratchet teeth to prevent removal of said lock device from said first leg when said lock device is locked.

12. The security device according to claim 11 wherein the pawl is spring loaded to permit the lock device to be telescoped onto the first leg while preventing it to be removed therefrom when the lock device is locked.

13. The security device according to claim 12 wherein the lock device includes a key lock which actuates the pawl to engage and disengage the ratchet teeth.

14. The security device according to claim 10 wherein said first and second legs are spaced apart a distance sufficient to straddle a width of the laptop computer, said rigid first securing member including an elongate rod extending between said legs, said security device further including a second securing member which can be releasably connected to said rigid first securing member to secure a laptop computer in a closed position to the support member, said second securing member including an elongate intermediate member and first and second stop members located at opposite ends thereof, said elongate rod and said intermediate member extending substantially at right angles to each other when said first and second securing members are connected together, whereby when the laptop computer is closed and positioned on the support member between the first and second holes, said first and second securing members are connected together and said first and second legs are inserted through the first and second holes respectively with said lock device engaged to said first leg, said first and second legs and first and second stop members restrain movement of said laptop computer parallel to the upper surface, and said elongate rod and intermediate member restrain upward movement of the laptop computer.

15. A security device for securing a laptop computer to a support member having a planar upper surface and a lower surface, the laptop computer having a monitor portion and a keyboard portion pivotally connected together by a hinge for movement between an open position in which the monitor portion extends at an angle from the keyboard portion, and a closed position in which the monitor portion and keyboard portion are substantially parallel to and adjacent each other, the laptop computer having a predetermined length, width and height when in its closed position, the security device comprising:

an elongate rigid first securing member;

first and second spaced apart parallel legs extending downwardly from said first securing member for insertion through first and second predetermined holes, respectively, provided through the support member, said legs being spaced apart a sufficient distance such that the rigid first securing member extends across the width of the laptop computer with said legs straddling the laptop computer when the laptop computer is in its closed position with its keyboard portion resting on the support member;

a second securing member comprising an elongate intermediate member having a first stop member extending downwardly from a first end thereof, and a second stop member extending downwardly from a second end thereof, said intermediate member being connectible substantially transversely to said first securing member, said first and second stop members being spaced apart a sufficient distance such that the intermediate member can extend across the length of the laptop computer with said stop members being positioned at opposite ends of the laptop computer;

a lock device for engaging the lower surface of the support member and a portion of the first leg inserted through the first hole thereby preventing separation of the first securing member from the support member when the lock device is locked, whereby when the laptop computer is positioned in the closed position on the upper surface of the support member between the first and second legs and said first leg is engaged by said lock device, said first and second legs, said first and second stop members, said first securing member and said intermediate member prevent removal of the laptop computer from the support member.

16. A security device according to claim 15 wherein said first leg includes a plurality of ratchet teeth spaced longitudinally therealong, and said lock device includes a pawl engageable with the ratchet teeth to prevent removal of said lock device from said first leg when said lock device is locked.

17. A security device according to claim 16 wherein the pawl is spring loaded to permit the lock device to be telescoped onto the first leg while preventing it to be removed therefrom when the lock device is locked.

18. A security device according to claim 17 wherein the lock device includes a key lock which actuates the pawl to engage and disengage the ratchet teeth.

* * * * *